US008107829B2

(12) United States Patent
Sato et al.

(10) Patent No.: US 8,107,829 B2
(45) Date of Patent: Jan. 31, 2012

(54) IMAGE FORMING APPARATUS WITH A DEVELOPER CIRCULATION MECHANISM

(75) Inventors: Shougo Sato, Seto (JP); Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 499 days.

(21) Appl. No.: 12/255,690

(22) Filed: Oct. 22, 2008

(65) Prior Publication Data

US 2009/0142079 A1 Jun. 4, 2009

(30) Foreign Application Priority Data

Dec. 4, 2007 (JP) ..... 2007-313792

(51) Int. Cl.
*G03G 15/08* (2006.01)
*G03G 21/00* (2006.01)

(52) U.S. Cl. ..... 399/27; 399/30; 399/254; 399/258; 399/358; 399/359

(58) Field of Classification Search ..... 399/29
See application file for complete search history.

(56) References Cited

U.S. PATENT DOCUMENTS

| | | | | |
|---|---|---|---|---|
| 4,323,306 | A | 4/1982 | Ito et al. | |
| 4,913,087 | A | 4/1990 | Saita et al. | |
| 5,285,250 | A * | 2/1994 | Yoshioka | 399/120 |
| 5,987,280 | A | 11/1999 | Sato et al. | |
| 6,337,956 | B1 * | 1/2002 | Sato et al. | 399/27 |
| 6,445,899 | B2 | 9/2002 | Sato | |
| 6,625,404 | B2 * | 9/2003 | Watanabe et al. | 399/30 |
| 2003/0138259 | A1 | 7/2003 | Watanabe et al. | |
| 2005/0170274 | A1 | 8/2005 | Matsumura et al. | |
| 2006/0078361 | A1 | 4/2006 | Park | |
| 2006/0093385 | A1 * | 5/2006 | Kamimura | 399/27 |
| 2006/0177241 | A1 * | 8/2006 | Sato et al. | 399/254 |
| 2007/0047992 | A1 | 3/2007 | Kubo | |
| 2007/0071503 | A1 * | 3/2007 | Sato | 399/258 |
| 2007/0154242 | A1 * | 7/2007 | Matsumoto et al. | 399/254 |
| 2007/0212120 | A1 * | 9/2007 | Sato | 399/262 |
| 2007/0264053 | A1 * | 11/2007 | Iwata et al. | 399/254 |
| 2008/0267641 | A1 * | 10/2008 | Konishi et al. | 399/27 |
| 2009/0087225 | A1 | 4/2009 | Sakuma | |
| 2009/0142079 | A1 | 6/2009 | Sato et al. | |
| 2009/0245823 | A1 | 10/2009 | Migita et al. | |

FOREIGN PATENT DOCUMENTS

JP 09-319202 12/1997

(Continued)

*Primary Examiner* — David Gray
*Assistant Examiner* — David Bolduc
(74) *Attorney, Agent, or Firm* — Banner & Witcoff, Ltd.

(57) ABSTRACT

An image forming apparatus includes: at least one retaining member configured to temporarily retain remaining developer remaining on a photosensitive member; a belt arranged opposite to a plurality of photosensitive members; a cleaning device collecting developer on the belt; a remaining developer collecting unit configured to cause the remaining developer retained by the retaining member to be transferred onto the belt via the photosensitive member and thereafter collected by the cleaning device; a circulation mechanism configured to circulate developer between the development chamber and the developer storage chamber; a detector detecting the amount of developer in the developer storage chamber; a determination unit configured to determine if the amount of developer in the developer storage chamber is less than a predetermined amount; and a notifying unit notifying to replace a developer receptacle when the amount of developer stored in the developer storage chamber becomes less than the predetermined amount.

7 Claims, 10 Drawing Sheets

FOREIGN PATENT DOCUMENTS

| | | | |
|---|---|---|---|
| JP | 2000-029365 | | 1/2000 |
| JP | 2000029365 A | * | 1/2000 |
| JP | 2001-166556 | | 6/2001 |
| JP | 2002-251070 A | | 9/2002 |
| JP | 2006-235518 | | 9/2006 |
| JP | 2007-065475 | | 3/2007 |

* cited by examiner

IMAGE FORMING APPARATUS WITH A DEVELOPER CIRCULATION MECHANISM

CROSS REFERENCE TO RELATED APPLICATION

This application claims the foreign priority benefit under Title 35, United States Code, §119(a)-(d) of Japanese Patent Application No. 2007-313792 filed on Dec. 4, 2007 in the Japan Patent Office, the disclosure of which is herein incorporated by reference in its entirety.

BACKGROUND OF THE INVENTION

The present invention relates to an image forming apparatus equipped with a plurality of photosensitive members, and a belt arranged opposite to these photosensitive members.

An image forming apparatus such as a color laser printer is generally known, which comprises a plurality of development devices each storing different color toner, a plurality of photosensitive drums each of which is supplied with toner from the corresponding development devices via a developing roller, and a belt arranged opposite to the plurality of photosensitive drums. In this image forming apparatus, a recording sheet is conveyed on the belt and passes through the plurality of photosensitive drums, during which different color toner retained on the surfaces of the respective photosensitive drums is continuously transferred onto the recording sheet so that color printing is performed on the recording sheet.

To perform high quality image forming in this kind of image forming apparatus, Japanese Laid-open Patent Publication No. 2000-29365 discloses an image forming apparatus which comprises drum cleaners each slidingly contacting with a corresponding photosensitive drum to collect excess toner adhered on the photosensitive drum, a belt cleaner slidingly contacting with a belt to collect excess toner adhered on the belt, and a controller configured to reverse the polarity of a voltage applied to each drum cleaner at a predetermined timing. According to this image forming apparatus, the controller causes the voltage applied to the drum cleaner to be reversed between plus and minus at the predetermined timing, so that toner retained on the drum cleaner moves onto the photosensitive drum and is then transferred from the photosensitive drum onto the belt. Toner on the belt is finally collected by the belt cleaner.

In this conventional image forming apparatus, however, when toner retained on the drum cleaner is collected by the belt cleaner via the photosensitive drum and the belt with the use of potential difference between the electric charge of toner and the voltage applied to the drum cleaner, toner transferred from the upstream-most photosensitive drum onto the belt passes between the belt and three other photosensitive drums arranged downstream from the upstream-most one. Therefore, during the passage of toner; for example, when toner transferred from the upstream-most photosensitive drum onto the belt passes through a second and a third photosensitive drum, if the electric charge of toner becomes higher due to an electric discharge phenomenon that occurs by the potential difference for moving toner, toner is repulsed to each other and when the toner passes through downstream-side photosensitive drums, the toner moves onto these photosensitive drums such as a fourth photosensitive drum in particular.

In this instance, if the drum cleaner for the fourth photosensitive drum retains a large amount of toner, different color toner that has moved onto the fourth photosensitive drum is moved by the rotation of the photosensitive drum without being collected by the drum cleaner, and then the toner moves onto a developing roller and further to a development device, so that different color toner is mixed in the development device.

This is particularly serious if the development device is of a type where a developer receptacle forming a developer storage chamber and a developing unit forming a development chamber are separable, because the developer receptacle is replaced with a new one for filling up toner and different color toner is gradually increased in the development chamber of the non-replaceable developing unit. As a content of mixed toner, namely a ratio of different color toner to the mixed toner, increases, a quality of a produced image deteriorates, which leads to reduced service life of the development device in the end.

In view of the foregoing drawbacks of the prior art, the present invention seeks to provide an image forming apparatus of a type where a developer receptacle is attached to and detachable from a developing unit, and which can restrict reduced service life of the developing unit.

SUMMARY OF THE INVENTION

According to the present invention, an image forming apparatus comprises: a plurality of photosensitive members; at least one retaining member positioned in contact with a corresponding photosensitive member and configured to temporarily retain remaining developer remaining on this photosensitive member; a belt arranged opposite to the plurality of photosensitive members; a cleaning device positioned in contact with the belt and configured to collect developer on the belt; a remaining developer collecting unit configured to cause the remaining developer retained by the retaining member to be transferred onto the belt via the photosensitive member and thereafter to be collected by the cleaning device; a plurality of developing units each including a developing roller positioned in contact with a corresponding photosensitive member to supply developer to the photosensitive member, and a development chamber accommodating the developing roller; a plurality of developer receptacles configured to be attached to and removed from corresponding developing units, and each having a developer storage chamber for storing developer; a circulation mechanism configured to circulate developer between the development chamber and the developer storage chamber; a detector detecting the amount of developer stored in the developer storage chamber; a determination unit configured to determine if the amount of developer stored in the developer storage chamber is less than a predetermined amount based on a signal from the detector; and a notifying unit configured to notify a user to replace a developer receptacle when the determination unit determines that the amount of developer stored in the developer storage chamber is less than the predetermined amount.

According to this image forming apparatus, even if different color developer is mixed within the development device, the different color developer is well-distributed over the whole regions of the development chamber and the developer storage chamber because the circulation mechanism circulates the different color developer between the development chamber and the developer storage chamber. Therefore, the different color developer is substantially equally mixed with the original developer stored in the developer storage chamber. In the following description, mixture of developer and different color developer is referred to as "mixed developer."

When the amount of mixed developer in the developer storage chamber becomes less than the predetermined amount, the notifying unit notifies the user to replace the developer receptacle so that the user can replace the developer receptacle with a new one with mixed developer remaining in the old developer receptacle. This allows a part of mixed developer within the development chamber and the developer storage chamber; more specifically, mixed developer within the developer storage chamber, to be replaced with new developer. Thereafter, the circulation mechanism again circulates developer between the development chamber and the developer storage chamber, so that mixed developer within the developer chamber is well mixed with the new developer and the content of mixed developer in the development chamber lowers. This makes it possible to prevent the content of mixed developer in the development chamber from being increased too high and therefore to restrict reduced service life of the developing unit.

According to the present invention, because the circulation mechanism circulates different color developer between the development chamber and the developer storage chamber and the developer receptacle can be replaced with a new one with mixed developer remaining in the old developer receptacle, it is possible to restrict reduced service life of the developing unit due to mixture of different color developer.

BRIEF DESCRIPTION OF THE DRAWINGS

Other objects and aspects of the present invention will become more apparent by describing in detail illustrative, non-limiting embodiments thereof with reference to the accompanying drawings, in which.

DETAILED DESCRIPTION OF THE INVENTION

One preferred embodiment of the present invention will be described in detail with reference to the attached drawings. In the following description, the overall structure of a color laser printer as an example of an image forming apparatus according to one embodiment of the present invention will be described with reference to FIG. 1, and thereafter, a development device as an embodiment of the present invention that is assembled into the color laser printer will be described in detail.

Overall Structure of Color Laser Printer

Figure 1:
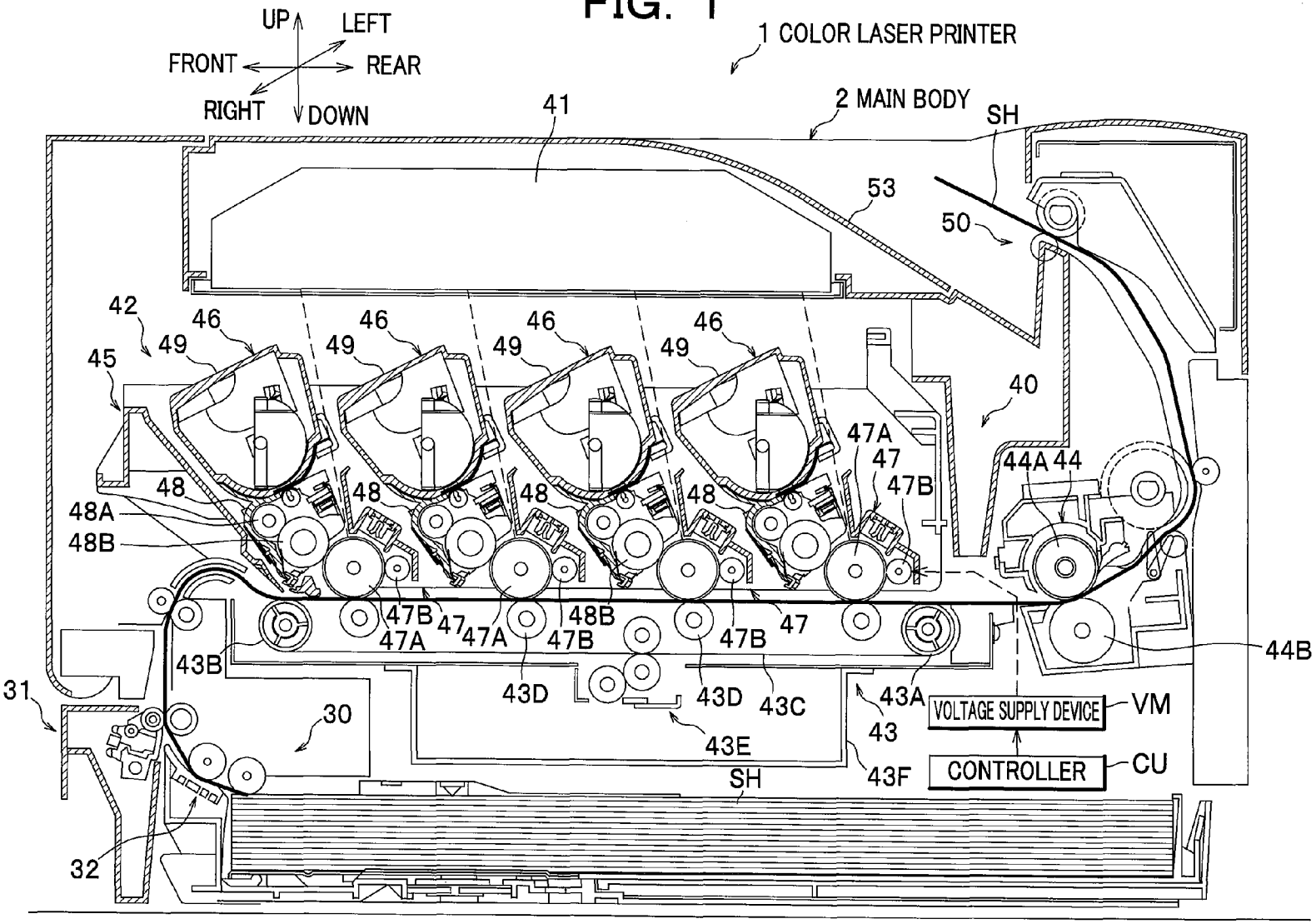
FIG. 1 is a vertical section showing the whole configuration of a color laser printer as an image forming apparatus according to one embodiment of the present invention.

As seen in FIG. 1, a color laser printer 1 as an embodiment of the present invention includes a sheet feed unit 30 configured to feed a recording sheet SH into a main body 2, an image forming unit 40 configured to form an image on the recording sheet SH fed from the sheet feed unit 30, and a sheet output unit 50 configured to discharge the recording sheet SH having the image thereon from the main body 2.

Directions of the color laser printer 1 as shown by arrows of FIG. 1, that is, up, down, right, left, front, and rear directions refer to the directions as seen from a user standing in front of and facing the color laser printer 1. In the following description, unless otherwise stated, directions such as up (upward), down (downward), right (right-side), left (left-side), front (near-side), and rear (far-side) directions correspond to those directions as shown by the arrows of FIG. 1.

Structure of Sheet Feed Unit 30

The sheet feed unit 30 includes a sheet feed tray 31 configured to be attached to and detachable from the main body 2, and a sheet feed mechanism 32 configured to convey a recording sheet SH from the sheet feed tray 31 to the image forming unit 40. The sheet feed mechanism 32 has known parts such as a feed roller, a separation roller, and a separation pad; reference numerals of these parts are omitted. The sheet feed mechanism 32 separates a stack of recording sheets SH stored in the sheet feed tray 31 and conveys a recording sheet SH on one-by-one basis upwardly toward the image forming unit 40 that is positioned above the sheet feed unit 30.

Structure of Image Forming Unit 40

The image forming unit 40 includes a scanner unit 41, a processing unit 42, a transfer unit 43, and a fixing unit 44.

Although not shown in the drawings, the scanner unit 41 includes a laser beam emission device, a polygon mirror, and a plurality of lenses and reflecting mirrors. The scanner unit 41 is configured to illuminate each photosensitive drum 47A of the processing unit 42 with a laser beam corresponding to one of cyan, magenta, yellow, and black.

Structure of Processing Unit 42

The processing unit 42 includes a photosensitive member unit 45 arranged between the scanner unit 41 and the transfer unit 43 and configured to be attached to and detachable from the main body 2. In this photosensitive member unit 45, a plurality of (i.e., four) process cartridges 46 are arranged along a recording sheet conveyance direction.

Structure of Process Cartridge 46

Four process cartridges 46 are arranged in tandem with their upper parts slightly tilted in the frontward direction. Each process cartridge 46 is equipped with a drum subunit 47 positioned at a lower part of the process cartridge 46, a developing unit 48 configured to be attached to and detachable from a side portion of the drum subunit 47, and a developer cartridge 49 as an example of a developer receptacle configured to be attached to and detachable from an upper part of the developing unit 48.

The drum subunit 47 includes a photosensitive drum 47A as an example of a photosensitive member, a drum cleaner 47B as an example of a retaining member, and a Scorotron charger (reference numeral omitted). The drum cleaner 47B is in the form of a roller and positioned in contact with the photosensitive drum 47A. Each drum cleaner 47B is electrically connected with a voltage supply device VM, and further the voltage supply device VM is electrically connected with a controller CU. The voltage supply device VM and the controller CU constitute an example of a remaining developer collecting unit. The controller CU controls the voltage supply device VM in an appropriate manner so that a positive or a negative voltage is applied to the drum cleaner 47B. The manner of controlling the electric voltage by the controller CU is well-known in the art and detailed description thereof is omitted.

The developing unit 48 includes a developing roller 48B and a supply roller 48A as an example of a developer supply member. The developer cartridge 49 stores as developer single component nonmagnetic toner (not shown) corresponding to one of colors including cyan, magenta, yellow, and black. Details of the developing unit 48 and the developer cartridge 49 will be described later.

In this processing unit 42 as described above, the Scorotron charger electrically charges the surface of the photosensitive drum 47A to a positive polarity, and thereafter the positively charged photosensitive drum is exposed to a laser beam emitted from the scanner unit 41 so that an electric potential of the exposed area lowers to form an electrostatic latent image associated with an image data on the surface of the photosensitive drum 47A. Positively charged toner is supplied from the developing roller 48B positioned in contact with the photosensitive drum 47A to the electrostatic latent image formed on the photosensitive drum 47A, so that a toner image is formed on the photosensitive drum 47A. The toner image formed on the photosensitive drum 47A is transferred onto the recording sheet SH between the photosensitive drum 47A and a transfer roller 43D as described later. However, if the transfer of toner is insufficient, toner may remain on the photosensitive drum 47A. In this instance, the positively charged remaining toner on the photosensitive drum 47A is collected by the drum cleaner 47B to which a negative voltage is applied, and temporarily retained on the surface of the drum cleaner 47B. Further, a positive voltage is applied to the drum cleaner 47B at a predetermined timing while the drum cleaner 47B retains remaining toner, so that the remaining toner moves from the drum cleaner 47B to the photosensitive drum 47A.

Structure of Transfer Unit 43

The transfer unit 43 includes a drive roller 43A, a follow roller 43B, a conveyor belt 43C, transfer rollers 43D, and a cleaning unit 43E as an example of a cleaning device.

The conveyor belt 43C is arranged opposite to the plurality of photosensitive drums 47A. When the drive roller 43A is driven to rotate, the conveyor belt 43C is driven and turns together with the follow roller 43B. The transfer rollers 43D are arranged inside the conveyor belt 43C. Each of the transfer rollers 43D is positioned opposite to the corresponding photosensitive drum 47A with the conveyor belt 43C interposed therebetween. A high voltage circuit board (not shown) applies a transfer bias to the transfer rollers 43D.

The cleaning unit 43E includes a plurality of rollers (reference numerals omitted) positioned below the conveyor belt 43C and in contact with the conveyor belt 43C. The cleaning unit 43E removes toner adhered on the conveyor belt 43C so that the removed toner is received and collected in a toner storage tank 43F that is positioned below the cleaning unit 43E.

According to this transfer unit 43, when the recording sheet SH is conveyed along the conveyor belt 43C and supplied between the photosensitive drum 47A and the transfer roller 43D, the toner image formed on the photosensitive drum 47A is attracted toward the transfer roller 43D so that the toner image is transferred onto the recording sheet SH. As described previously, in the case where a positive voltage is applied to the drum cleaner 47B and remaining toner on the drum cleaner 47B is moved to the photosensitive drum 47A, the remaining toner is attracted by the transfer roller 43D and transferred from the photosensitive drum 47A to the conveyor belt 43C. The remaining toner on the conveyor belt 43C is then conveyed by the conveyor belt 43C to the cleaning unit 43E, at which the remaining toner is collected from the conveyor belt 43C.

Structure of Fixing Unit 44

The fixing unit 44 includes a heating roller 44A and a pressure roller 44B. In this fixing unit 44, the recording sheet SH is nipped between the heating roller 44A and the pressure roller 44B and conveyed out therefrom during which the toner image on the recording sheet SH is thermally fixed.

Structure of Sheet output Unit 50

The sheet output unit 50 includes a plurality of conveyance rollers (reference numerals omitted) such that the recording sheet SH discharged from the fixing unit 44 is conveyed upward toward a sheet output tray 53 positioned above the fixing unit 44.

Structure of Development Device

Figure 2:
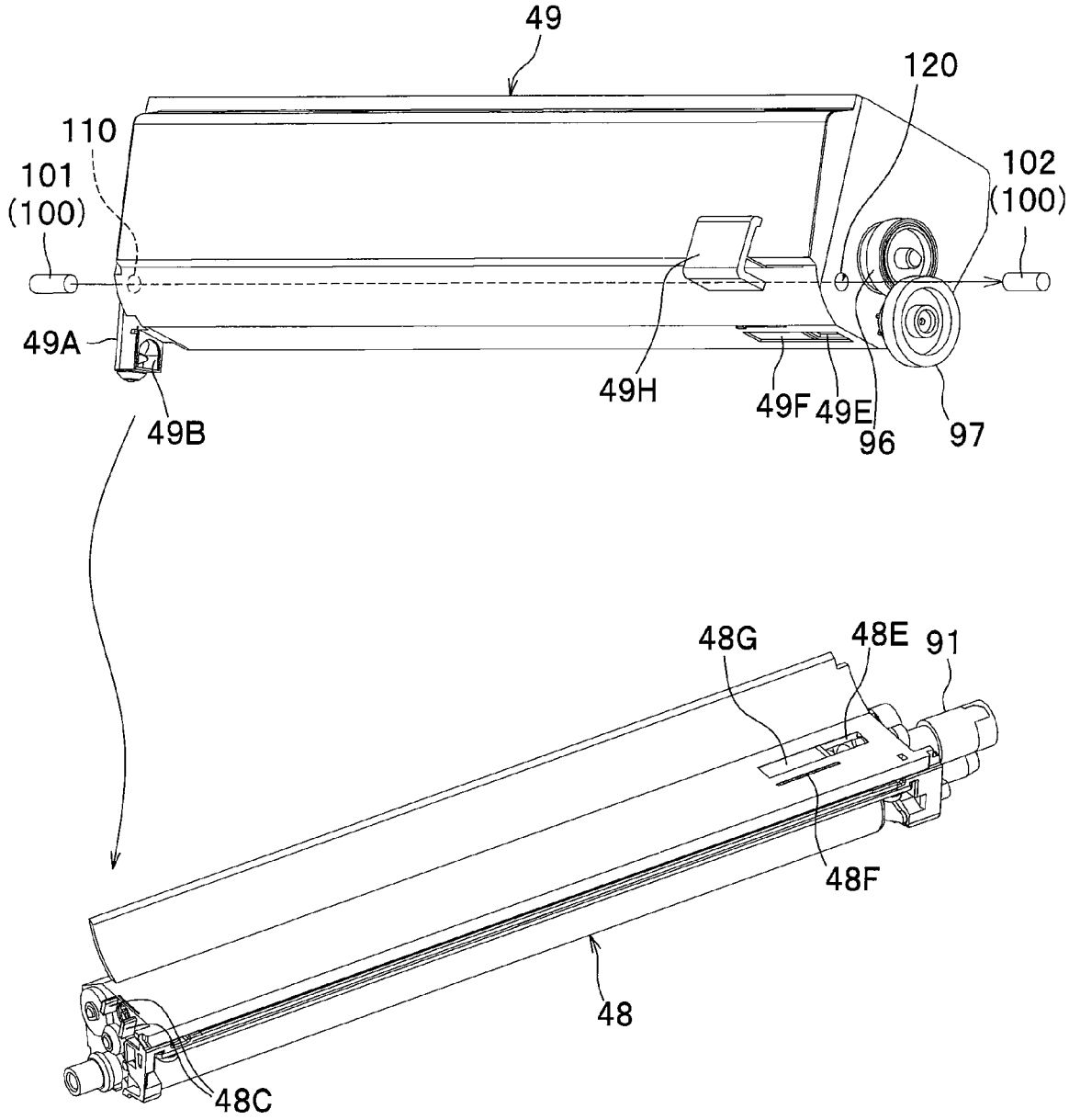
FIG. 2 is an exploded perspective view of a developer cartridge and a developing unit as shown in FIG. 1, which constitute a development device according to one embodiment of the present invention.
Figure 3:
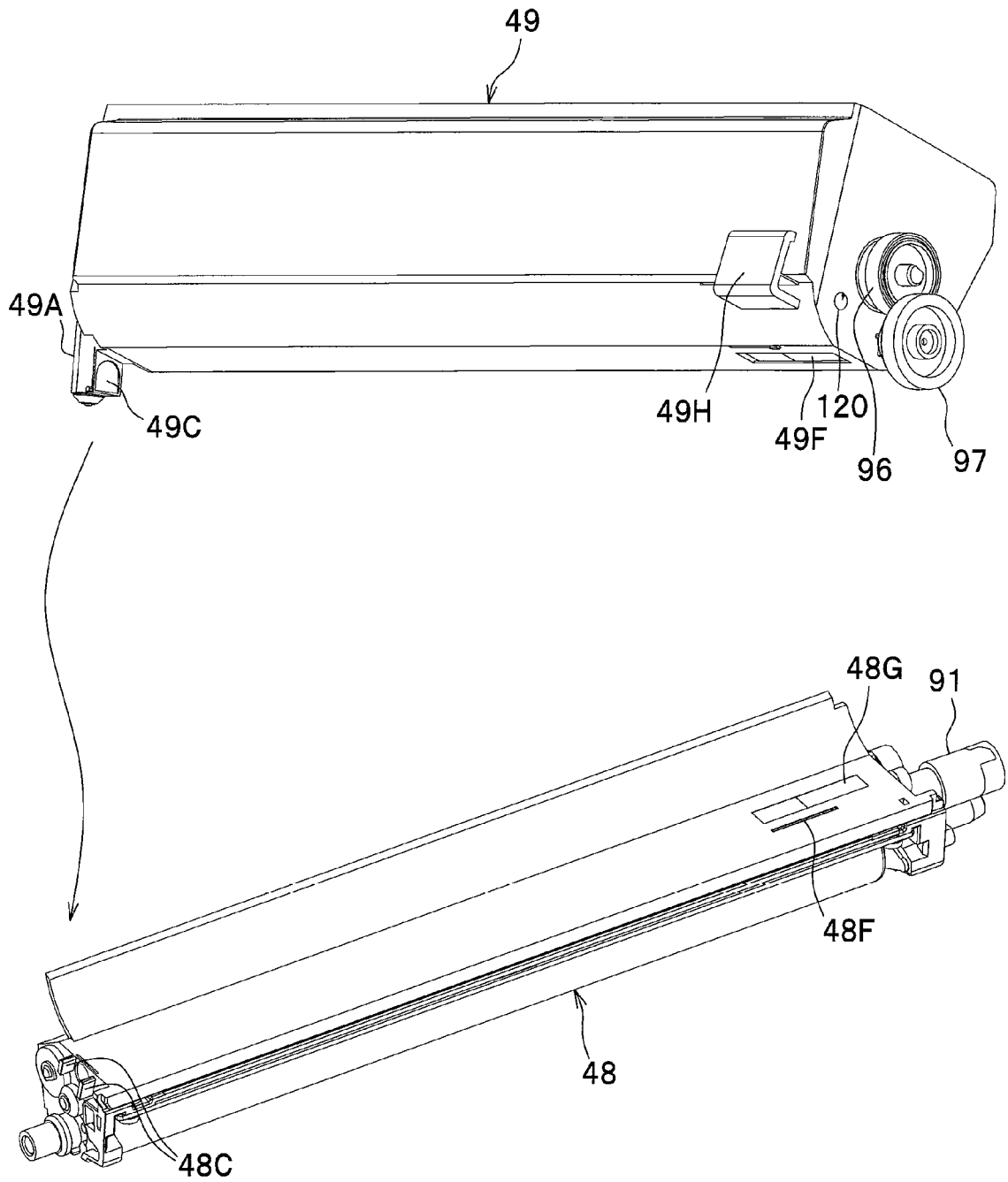
FIG. 3 is an exploded perspective view similar to FIG. 2, but showing a state where shutters of the developer cartridge and the developing unit are closed.

External appearances of the developing unit 4 8 and the developer cartridge 49, which constitute the aforementioned process cartridge 46, are shown in FIGS. 2 and 3. The developing unit 48 defines therein a development chamber, and the developer cartridge 49 defines therein a developer storage chamber. The developing unit 48 and the developer cartridge 49 constitute the development device according to one embodiment of the present invention.

Removable Structure of Development Device

A cylindrical communicating member 49A is provided at a second end portion (right end portion as shown by the arrow of FIG. 1) of the elongated developer cartridge 49; that is, a left-side of FIGS. 2 and 3. The cylindrical communicating member 49A projects downward and configured to be removably attached to and in communication with a second end portion of the developing unit 48. A pair of front and rear receiving strips 48C are provided at the second end portion of the elongated developing unit 48 (one end of the development chamber along its width direction) corresponding to the cylindrical communicating member 49A. The lower end of the cylindrical communicating member 49A of the developer cartridge 49 is fitted into and detachable from a space between the front and rear receiving strips 48C, 48C. When the developer cartridge 49 is attached to the upper part of the developing unit 48, the developer storage chamber is arranged in position above the development chamber.

Communication Mechanism of Development Device

Figure 4A:
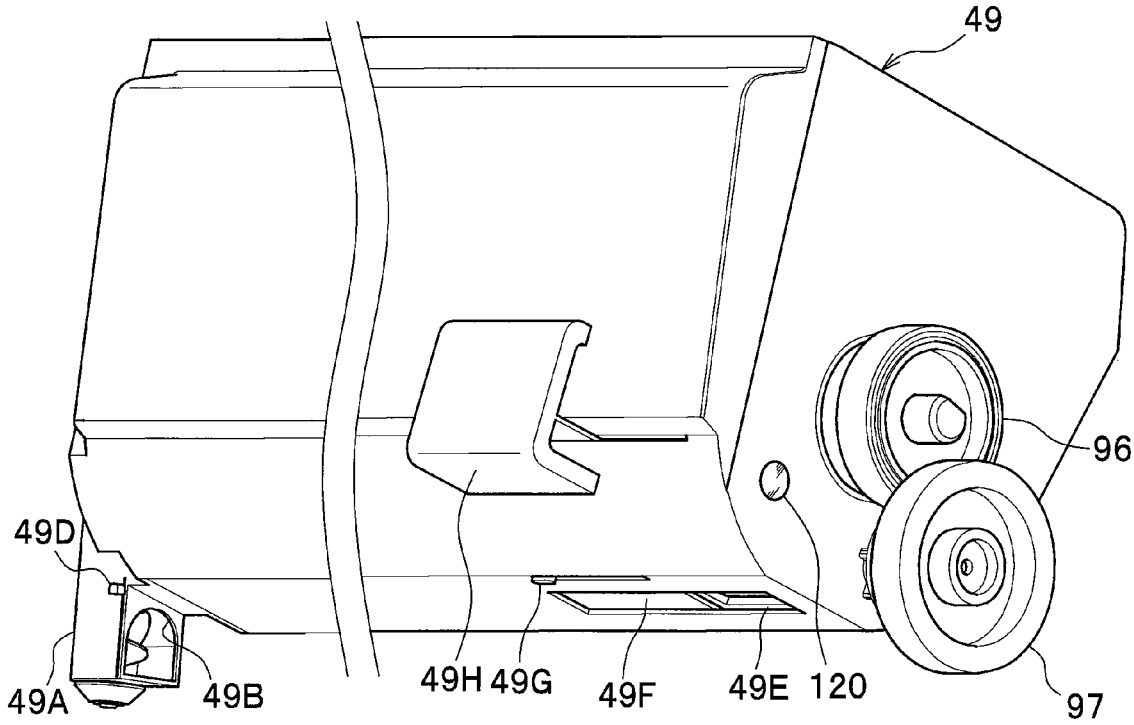
FIG. 4A is an enlarged exploded perspective view showing main parts of the developer cartridge of FIG. 2.
Figure 4B:
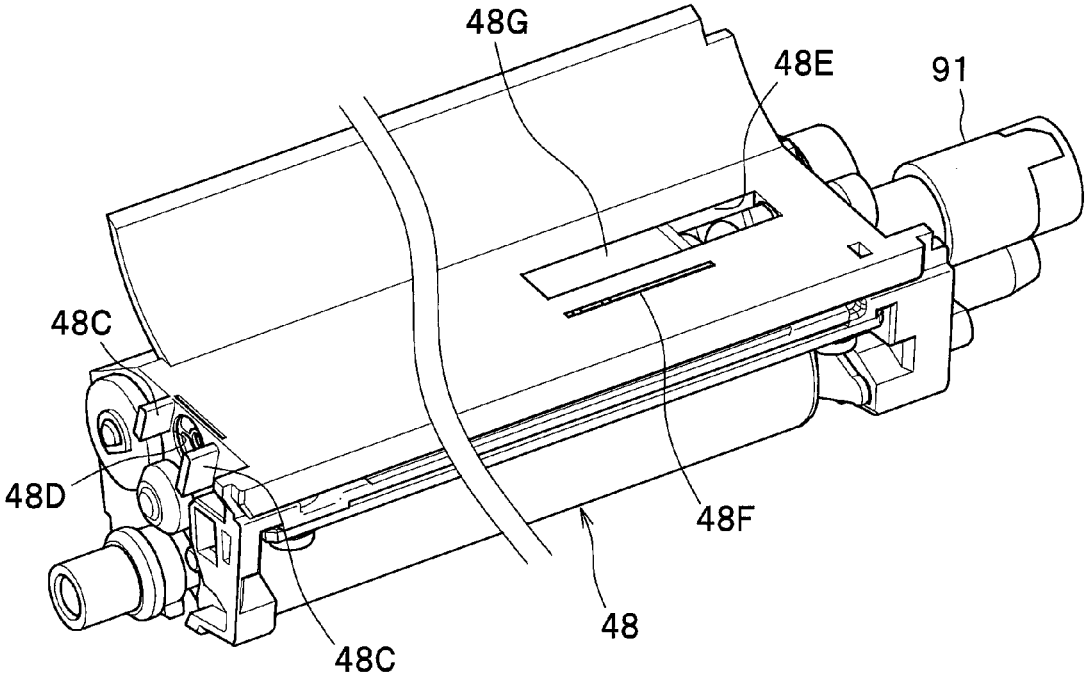
FIG. 4B is an enlarged exploded perspective view showing main parts of the developing unit of FIG. 2.

As shown by enlarged drawings of FIGS. 4A and 4B, a communication opening 48D as an example of a second opening of the development chamber is formed in the second end portion of the developing unit 48. The communication opening 48D is open between the pair of receiving strips 48C, 48C. Also, a communication opening 49B as an example of a second opening of the developer storage chamber is formed in the lower end portion of the cylindrical communicating member 49A of the developer cartridge 49 facing inward to the developer storage chamber of the developer cartridge 49. The communication opening 49B comes into communication with the communication opening 48D.

Figure 5A:
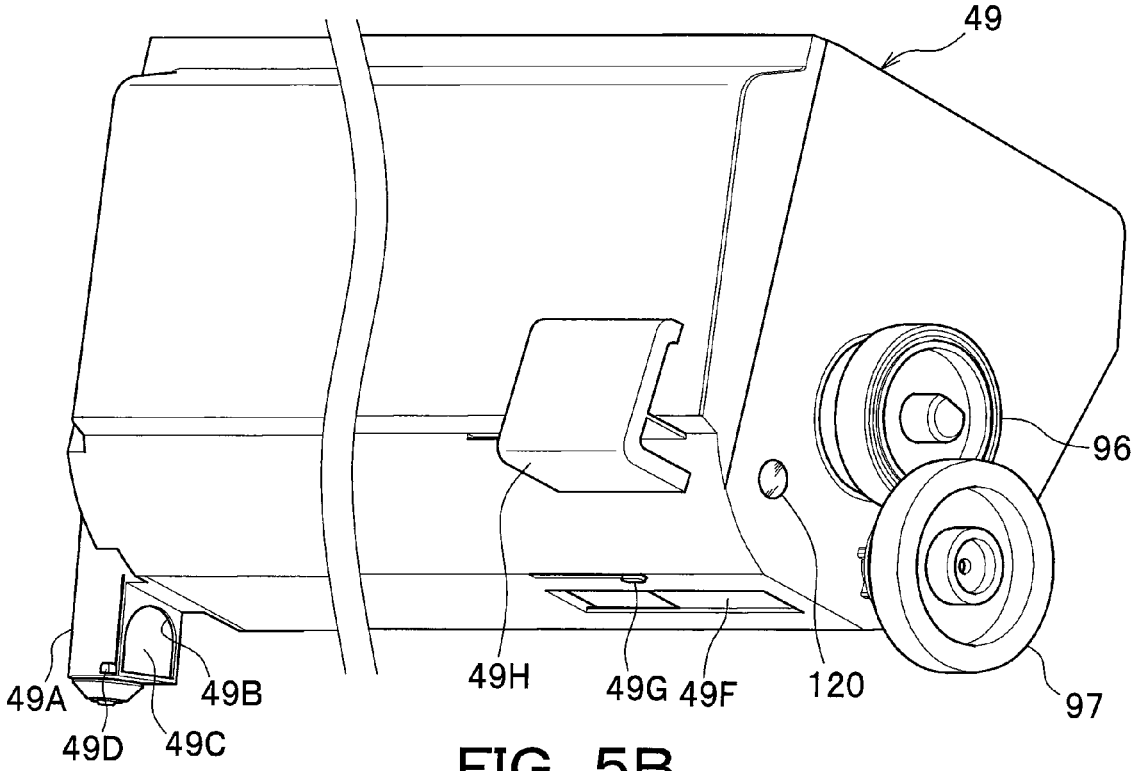
FIG. 5A is an enlarged exploded perspective view showing main parts of the developer cartridge of FIG. 3.
Figure 5B:
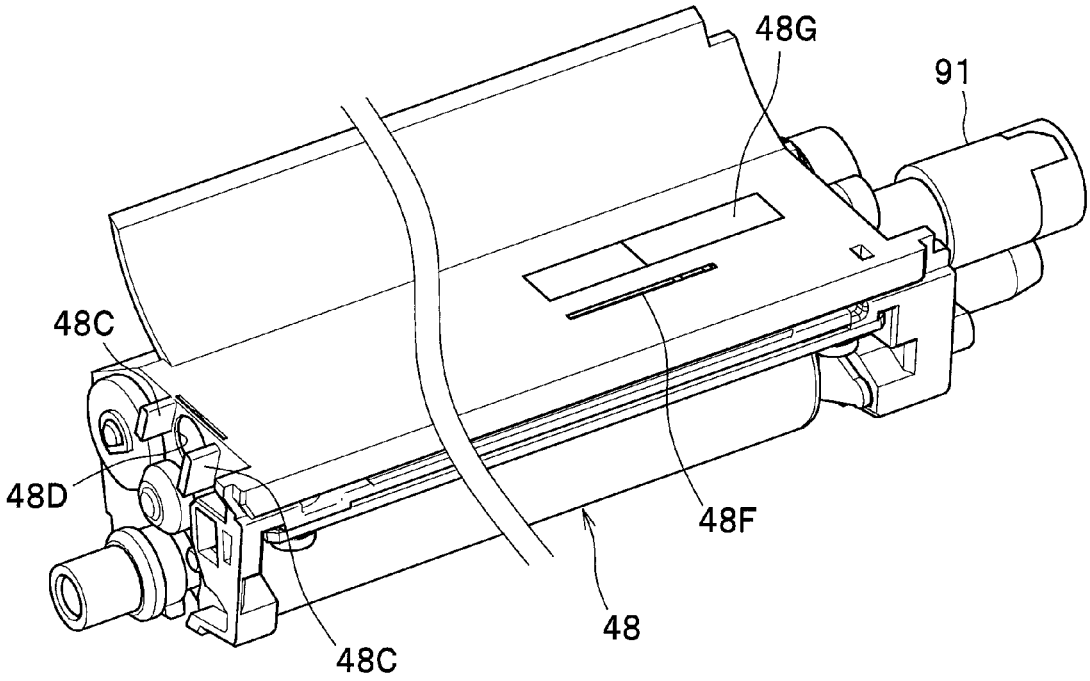
FIG. 5B is an enlarged exploded perspective view showing main parts of the developing unit of FIG. 3.

As best seen in the enlarged drawing of FIG. 5A, a shutter member 49C for opening and closing the communication opening 49B is slidably attached to the lower end portion of the cylindrical communicating member 49A. The shutter member 49C is slidable in vertical directions. An engagement protrusion 49D is integrally formed on the shutter member 49C. The engagement protrusion 49D protrudes from a side wall of the cylindrical communicating member 49A in a direction toward the viewer of the drawing. When the engagement protrusion 49D comes into engagement with the upper end of one of the receiving strips 48C provided on the developing unit 48 and is urged upward by inserting the cylindrical communicating member 49A into the space between the receiving strips 48C, 48C, the shutter member 49C slides upward to open the communication opening 49B of the cylindrical communicating member 49A (see FIG. 4A).

As seen in FIG. 4A, a communication opening 49E as an example of a first opening of the developer storage chamber is formed in the lower surface of the developer cartridge 49 at a first end portion (right-side of the drawing) opposite to the second end portion of the developer cartridge 49. In order to open and close the communication opening 49E, a shutter member 49F is slidably attached to the first end portion of the developer cartridge 49. The shutter member 49F is slidable in horizontal directions.

An engagement protrusion 49G and a handle knob 49H are integrally formed with the shutter member 49F. The engagement protrusion 49G protrudes downward from the lower surface of the developer cartridge 49 at the first end portion of the developer cartridge 49. The handle knob 49H protrudes from the first end portion of the developer cartridge 49 in a direction toward the viewer of the drawing. As seen in FIG. 5A, when the handle knob 49H is operated in the right-hand direction of the drawing, the shutter member 49F slides in the same direction together with the engagement protrusion 49G so as to close the communication opening 49E.

Meanwhile, as seen in FIG. 4B, a communication opening 48E as an example of a first opening of the development chamber and a slit 48F are formed in the upper surface of the developing unit 48 at a first end portion (right-side of the drawing) opposite to the second end portion of the elongated developing unit 48. The communication opening 48E is facing to and comes into communication with the communication opening 49E of the developer cartridge 49. The slit 48F is configured to allow the insertion of the engagement protrusion 49G of the developer cartridge 49. In order to open and close the communication opening 48E, a shutter member 48G is slidably attached to the first end portion of the developing unit 48. The shutter member 48G is slidable in horizontal directions.

An engagement recess (not shown) is provided on the shutter member 48G. The engagement recess is positioned below the slit 48F and engageable with the engagement protrusion 49G of the developer cartridge 49. As shown in FIG. 5A, when the handle knob 49H of the developer cartridge 49 is operated in the right-hand direction of the drawing, the shutter member 48G slides in the same direction in synchronization with the engagement protrusion 49G to close the communication opening 48E of the developing unit 48.

Internal Structure of Development Device

Figure 6:
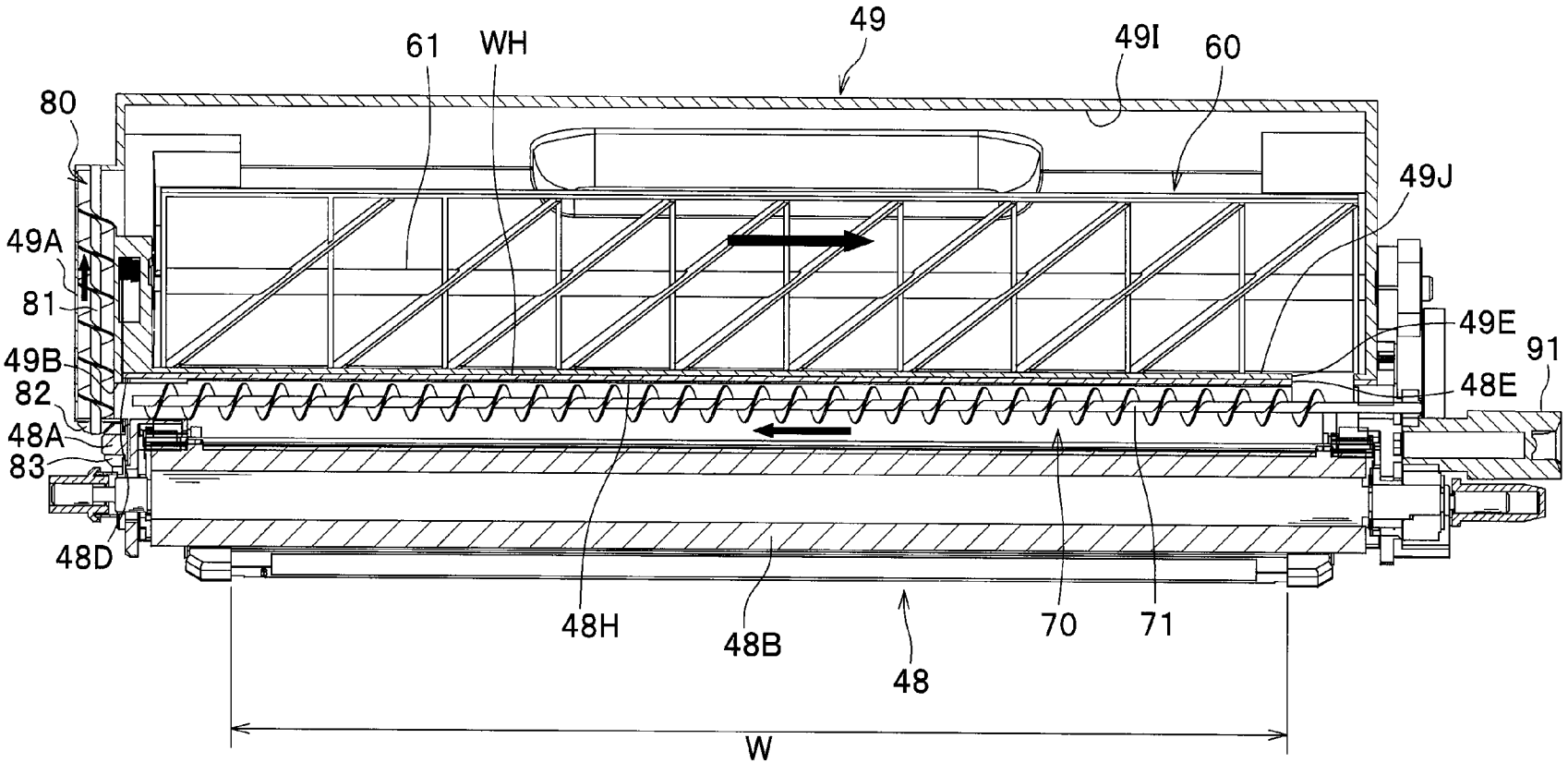
FIG. 6 is a vertical section showing the internal structure of the development device comprising the developer cartridge and the developing unit as shown in FIG. 2.

As best seen in FIG. 6, a development chamber 48H of the developing unit 48 and a developer storage chamber 49I of the developer cartridge 49 are divided by a partition wall WH. In this embodiment, the partition wall WH consists of a lower wall of the developer cartridge 49 shown in FIG. 4A, an inward-side wall of the cylindrical communicating member 49A facing inward to the developer storage chamber 49I of the developer cartridge 49, an upper wall of the developing unit 48 shown in FIG. 4B, and a side wall (left-side wall of FIG. 4B) of the developing unit 48 facing to the development chamber 48H. As seen in FIG. 6, the communication opening 48D of the developing unit 48 and the communication opening 49B of the developer cartridge 49 are brought into communication with each other at the second end portion (left-side end portion of the drawing) of the elongated partition wall WH, whereas the communication opening 48E of the developing unit 48 and the communication opening 49E of the developer cartridge 49 are brought into communication with each other at the first end portion of the elongated partition wall WH. To facilitate explanation, structures around the communication openings 48D, 49B, 48E, and 49E are schematically shown.

Structure of Feed Out Carrier Mechanism

An agitator 60 as an example of a feed out carrier mechanism is arranged in the developer storage chamber 49I of the developer cartridge 49. When the agitator 60 is driven to rotate about its rotation shaft 61, the agitator 60 agitates and carries toner in a direction from the second end side to the first end side of the developer storage chamber 49I, and also feeds the toner out from the developer storage chamber 49I to the development chamber 48H through the communication openings 49E and 48E.

Structure of Supply Carrier Mechanism

An auger 70 as an example of a supply carrier mechanism is arranged in the development chamber 48H of the developing unit 48. The auger 70 is horizontally arranged above the developing roller 48B along the partition wall WH such that a second end portion of the auger 70 extends toward the communication opening 48D. When the auger 70 is driven to rotate about its rotation shaft 71, the auger 70 carries toner in a direction from the first end side of the development chamber 48H toward the communication opening 48D provided at the second end side of the development chamber 48H, and also supplies the toner to the developing roller 48B that is positioned below the auger 70.

Structure of Collection Carrier Mechanism

An auger 80 as an example of a collection carrier mechanism is arranged within the developer storage chamber 49I of the developer cartridge 49 at its second end side. To be more specific, the auger 80 is positioned in the cylindrical communicating member 49A that is arranged outside an image forming width (see reference character W of FIG. 6) to be defined within the development chamber 48H of the developing unit 48. The auger 80 is arranged in the vertical direction orthogonal to the axial direction of the supply roller 48A shown in FIG. 1. The lower end of the auger 80 extends toward the communication opening 49B.

When the auger 80 is driven to rotate about its rotation shaft 81, toner is carried by the auger 80 from the second end side of the development chamber 48H to the second end side of the developer storage chamber 49I. In other words, the auger 80 takes in toner through the communication opening 49B; the toner has been carried by the auger 70 from the first end side of the development chamber 48H to the communication opening 48D provided at the second end side of the development chamber 48H, and then carries the toner toward the upper part of the developer storage chamber 49I at the second end side of the developer storage chamber 49I, so that the auger 80 collects toner from the development chamber 48H and supplies it to the developer storage chamber 49I that is positioned above the development chamber 48H.

Figure 7A:
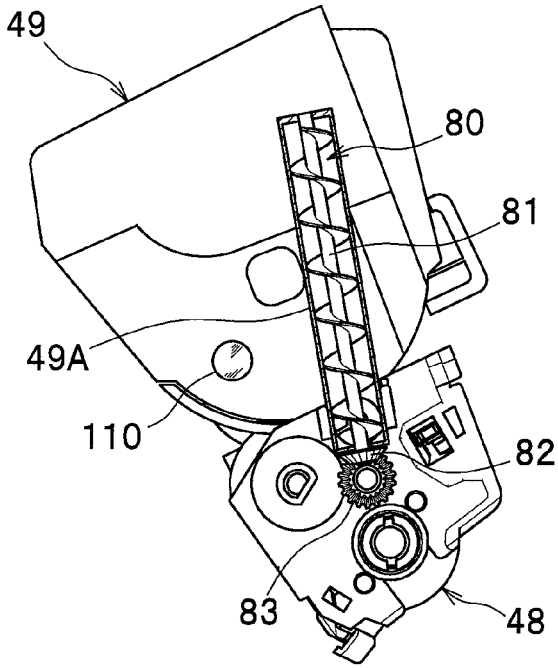
FIG. 7A is a side view showing second ends of the developer cartridge and the developer unit as shown in FIG. 6.
Figure 7B:
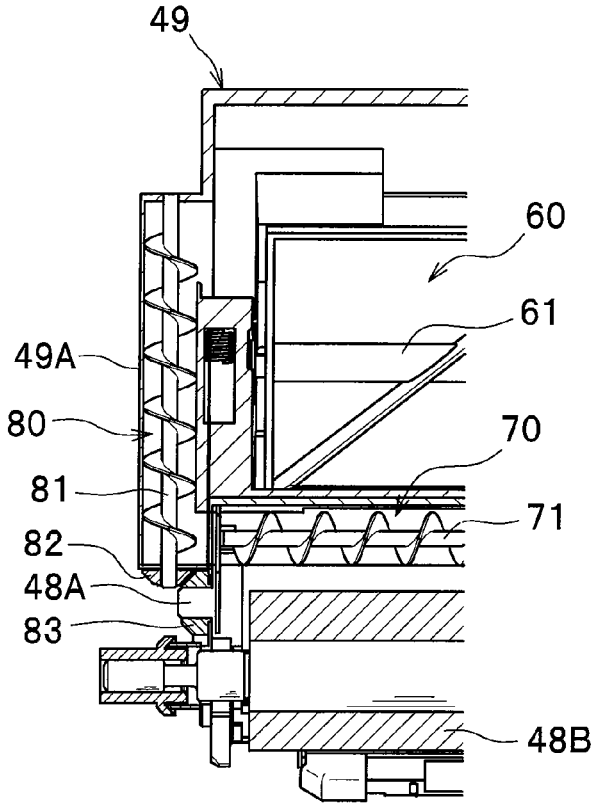
FIG. 7B is an enlarged sectional view partly showing the second end side of FIG. 7A.

As best seen in FIGS. 7A and 7B, an auger drive mechanism for rotating the auger 80 in synchronization with the rotation of the supply roller 48A is provided at the second end of the developing unit 48. To be more specific, the lower end portion of the rotation shaft 81 of the auger 80 protrudes from the lower end of the cylindrical communicating member 49A, and a driven bevel gear 82 is fixed to this protruding end. A driving bevel gear 83 meshing with the driven bevel gear 82 is fixed to a second end portion of the supply roller 48A that protrudes from the second end of the developing unit 48.

Structure of Rotary Driving Force Transmission Mechanism

Figure 8A:
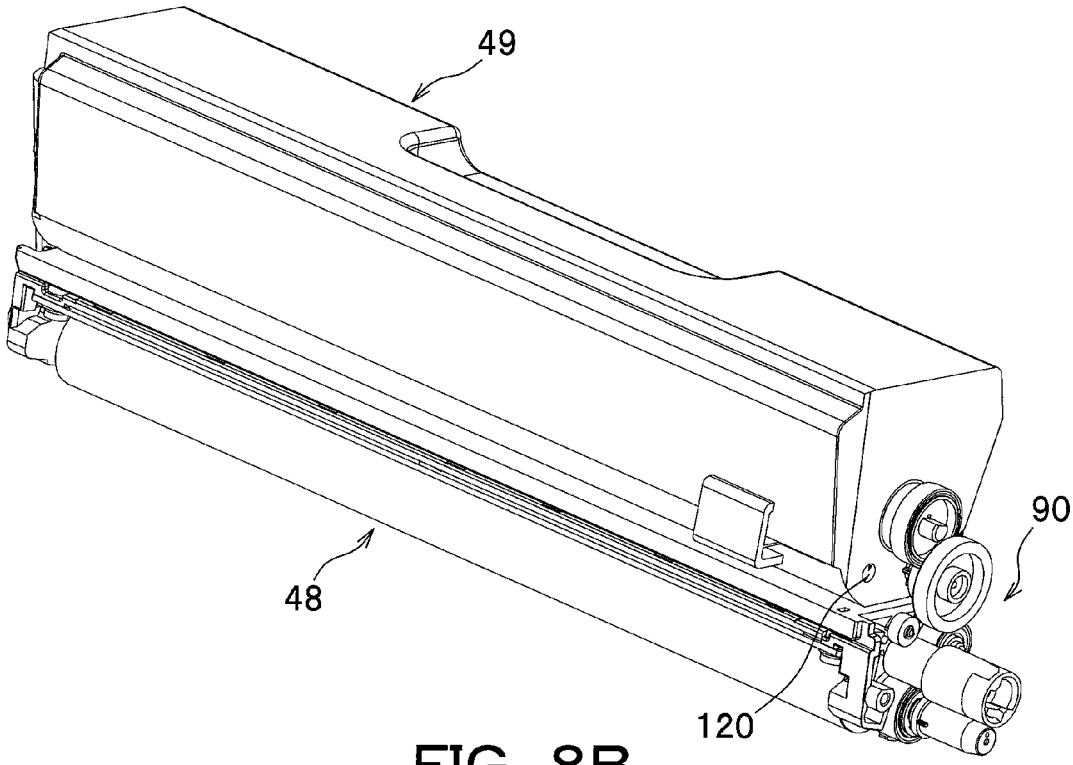
FIG. 8A is a perspective view showing the external appearance of the development device comprising the developer cartridge and the developing unit as shown in FIG. 2.

As seen in FIG. 8A, a rotary driving force transmission mechanism 90 for driving the auger 70 and the agitator 60 is arranged at the first ends of the developing unit 48 and the developer cartridge 49. This rotary driving force transmission mechanism 90 also functions as a rotary drive mechanism for the supply roller 48A and the developing roller 48B, which are accommodated in the developing unit 48 as shown in FIG. 1.

Figure 8B:
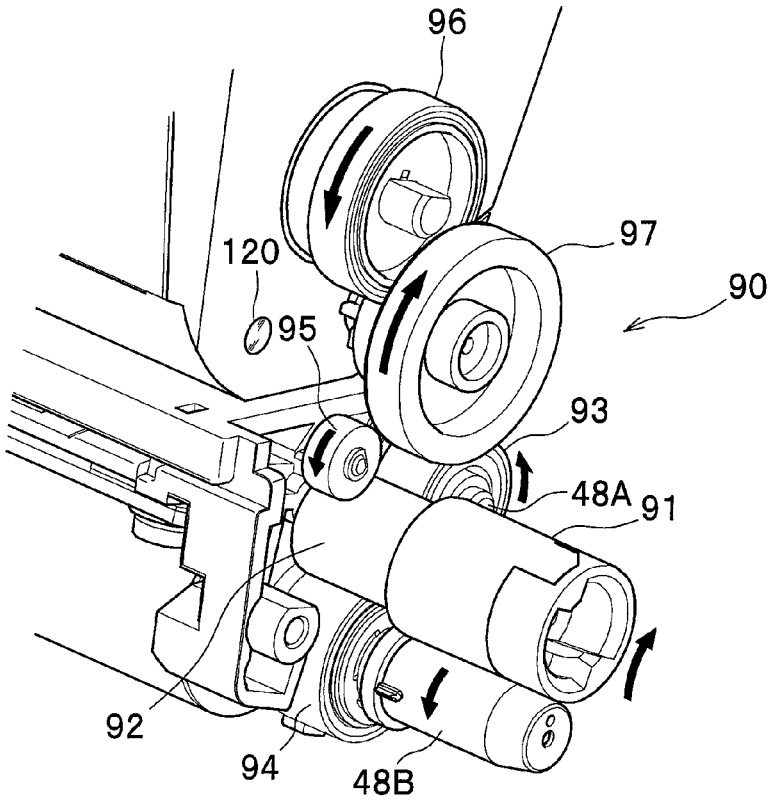
FIG. 8B is an enlarged perspective view partly showing first ends of the developer cartridge and the developer unit.

As best seen in FIG. 8B, a drive gear 92 is provided on an input shaft 91, and the drive gear 92 is meshed with a driven gear 93 fixed at the first end portion of the supply roller 48A, a driven gear 94 fixed at the first end portion of the developing roller 48B, and a driven gear 95 fixed at the first end portion of the auger 70, respectively. Further, the driven gear 93 of the supply roller 48A is meshed with a driven gear 96 fixed at the first end portion of the agitator 60 via double reduction gears 97 having a large and small gears.

By this rotary driving force transmission mechanism 90, the auger 70 as the supply carrier mechanism is driven to rotate together with the supply roller 48A and the developing roller 48B at an increased speed in a direction reverse to the rotating direction of the input shaft 91, and the agitator 60 as the feed out carrier mechanism is driven to rotate at a reduced speed in a direction reverse to the rotating direction of the input shaft 91. Accordingly, the rotary driving force is transmitted from the first end portion of the supply roller 48A to the lower end portion of the auger 80 as the collection carrier mechanism.

According to this color laser printer 1 as constituted above, in the respective process cartridges 46 which constitute the processing unit 42 of the image forming unit 40, when the input shaft 91 shown in FIG. 6 is rotated, toner stored in the developer storage chamber 49I of the developer cartridge 49 enters the development chamber 48H of the developing unit 48 and travels through the development chamber 48H and again enters the developer storage chamber 49I, so as to circulate the toner between the developer storage chamber 49I and the development chamber 48H.

To be more specific, when the agitator 60 arranged in the developer storage chamber 49I is driven to rotate, toner stored in the developer storage chamber 49I is carried from the second end side to the first end side within the developer storage chamber 49I and into the development chamber 48H. Thereafter, the toner is carried from the first end side to the second end side within the development chamber 48H by the rotation of the auger 70 arranged in the development chamber 48H. Further, by the rotation of the auger 80 arranged in the developer storage chamber 49I, the toner is carried out from the second end side of the development chamber 48H and into the second end side of the developer storage chamber 49I that is positioned above the development chamber 48H. Therefore, toner is reliably circulated between the developer storage chamber 49I and the development chamber 48H.

Mechanism for Notifying User to Replace Developer Cartridge

As seen in FIG. 2, an optical sensor 100 is provided at both ends of the developer cartridge 49. The optical sensor(s) 100 is an example of a detector for detecting the amount of toner stored in the developer cartridge 49. The optical sensor 100 consists of a light emitting portion 101 configured to emit light, and a light receiving portion 102 configured to receive the light emitted from the light emitting portion 101.

Further, a detection window 110 and a light transmission window 120, which are facing opposite to each other, are provided at the same height at both side walls of the developer cartridge 49. As seen in FIG. 6, the detection window 110 and the light transmission window 120 are positioned higher than the bottom face 49J of the developer cartridge 49. The positions of the detection window 110 and the light transmission window 120 in the vertical direction from the bottom face 49J is set appropriately in accordance with the amount of toner remaining in the developer cartridge 49. In this embodiment, the amount of toner remaining in the developer cartridge 49 is set equal to the remaining amount of toner remaining in the development chamber 48H. Hereinafter, the term "remaining amount" indicates the amount of toner (developer) remaining in the development chamber 48H of the developing unit 48 upon replacement of the developer cartridge 49.

Figure 9:
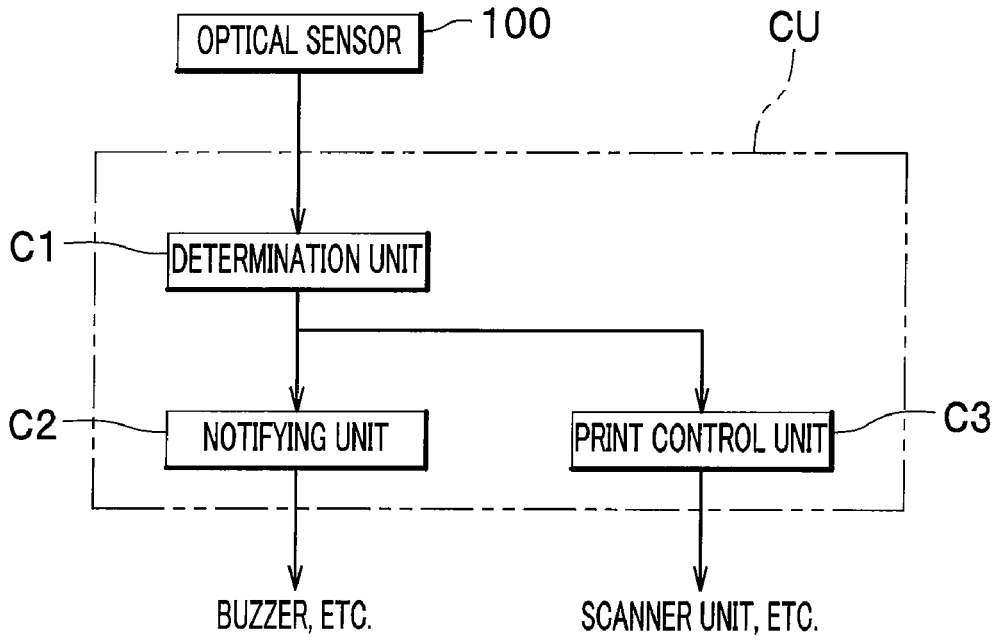
FIG. 9 is a block diagram illustrating the configuration of a controller.

According to this arrangement of the optical sensors 100, the detection window 110, and the light transmission window 120, light emitted from the light emitting portion 101 goes into the developer cartridge 49 through the detection window 110, and travels parallel to the bottom face 49J of the developer cartridge 49 (see FIG. 6), and thereafter passes through the light transmission window 120 to an outside of the developer cartridge 49 so as to be received by the light receiving portion 102. As shown in FIG. 9, when the light is received by the light receiving portion 102, a signal indicating receipt of light is outputted to the controller CU.

With reference to FIG. 9, the controller CU will be described in detail. Although not shown in the drawings, the controller CU includes conventionally known computer hardware such as a CPU, a ROM, a RAM, and a communication device. In FIG. 9, each of the blocks illustrates the function of the above hardware and a CPU into which a program has been read in from the ROM.

As seen in FIG. 9, the controller CU mainly includes a determination unit Cl, a notifying unit C2, and a print control unit C3.

The determination unit C1 functions to determine if the amount of toner stored in the developer storage chamber 49I is less than a predetermined amount based on the signal from the optical sensor 100. To be more specific, when the determination unit C1 receives from the optical sensor 100 the signal indicating that the light emitted from the light emitting portion 101 is received by the light receiving portion 102, the determination unit C1 determines that the amount of toner stored in the developer storage chamber 49I becomes less than the predetermined amount, and then sends an empty signal to the notifying unit C2 and the print control unit C3.

The notifying unit C2 functions to notify the user to replace the developer cartridge 49. When the notifying unit C2 receives the empty signal from the determination unit Cl, the notifying unit C2 actuates a buzzer or displays a screen message on a control panel.

The print control unit C3 functions to stop the operation of the scanner unit 41 to stop the printing operation when it receives the empty signal from the determination unit C1.

Figure 10:
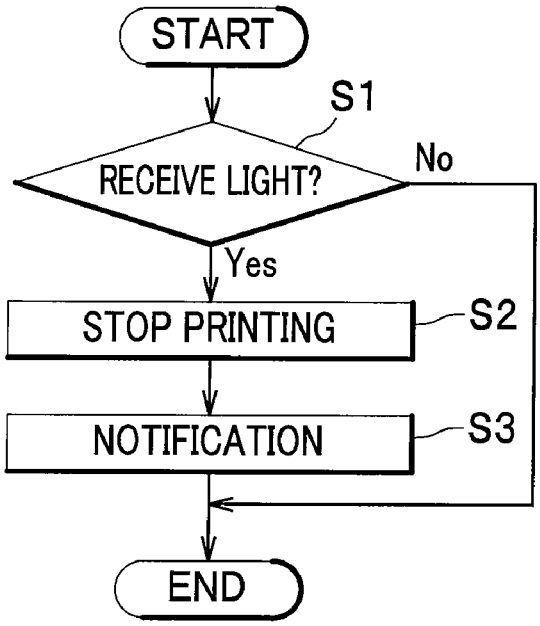
FIG. 10 is a flow chart showing the operation of the controller.

The controller CU as constituted above performs control according to the flowchart of FIG. 10. To be more specific, the controller CU always checks whether the light receiving portion 102 of the optical sensor 100 receives the light from the light emitting portion 101 while the color laser printer 1 is in operation, so that a determination is made as to whether the amount of toner stored in the developer storage chamber 49I becomes less than the predetermined amount (S1). In step S1, if a determination is made that the light receiving portion 102 has not received the light from the light emitting portion 101 (No; step S1), the controller CU temporarily finishes the process according to this flow chart and returns to the process of step S1.

In step S1, if a determination is made that the light receiving portion 102 has received the light from the light emitting portion 101 (Yes; step S1), the controller CU then stops the printing operation (S2) and notifies the user to replace the developer cartridge 49 by means of buzzer, etc (S3).

Description will be given of a case in which mixture of different color toner occurs in the color laser printer 1 according to this embodiment.

As seen in FIG. 1, when the predetermined amount of remaining toner is retained by the drum cleaner 47B, the controller CU controls the voltage supply device VM to apply a positive voltage to the drum cleaner 47B. This causes the remaining toner on the drum cleaner 47B to move on to the photosensitive drum 47A and thereafter to transfer from the photosensitive drum 47A onto the conveyor belt 43C. The remaining toner carried on the conveyor belt 43C is finally collected by the cleaning unit 43E.

In this instance, the remaining toner transferred from the upstream-most process cartridge 46 (one positioned in the front side) onto the conveyor belt 43C passes through the three other downstream photosensitive drums 47A, during which the electric charge of the remaining toner gradually increases due to an electric discharge phenomenon that occurs by the potential difference between the photosensitive drums 47A and the transfer rollers 43D. If the electric charge of the remaining toner is so high, the remaining toner may enter the development chamber 48H (see FIG. 6), for example, through the photosensitive drum 47A, the developing roller 48B, and the supply roller 48A that are positioned at the downstream-most side (rear end side), so that mixture of different color toner occurs. However, according to this embodiment, even if mixture of different color toner occurs, the different color toner is well-distributed because toner is circulated as shown in FIG. 6between the development chamber 48H and the developer storage chamber 49I that is arranged opposite to the development chamber 48H with the partition wall WH interposed therebetween. To be more specific, different color toner that has entered the development chamber 48H is uniformly mixed with toner in the development chamber 48H and also uniformly mixed with toner in the developer storage chamber 49I. Hereinafter, mixture of toner and different color toner is referred to as "mixed toner". The content of such uniformly mixed and well-distributed mixed toner (i.e., ratio of different color toner to the mixed toner) is substantially equal between the development chamber 48H and the developer storage chamber 49I.

The amount of toner stored in the developer storage chamber 49I gradually decreases by the repeated use of the color laser printer 1. When the top surface of the toner in the developer storage chamber 49I lowers below the level of the detection window 110 and the light transmission window 120, the optical sensor 100 is conducted to notify the user to replace the developer cartridge 49. The user then replaces the developer cartridge 49 with a new one. This allows a part of the mixed toner in the development chamber 48H and the developer storage chamber 49I (specifically, mixed toner stored in the developer storage chamber 49I) to be replaced with new toner. Thereafter, toner is again circulated between the development chamber 48H and the developer storage chamber 49I, so that the mixed toner in the development chamber 48H is well mixed and uniformly distributed with new toner. As a result, the content of the mixed toner in the development chamber 48H decreases.

To facilitate understanding, description will be given of a specific example with numerical values. It is assumed that 0.2 g of different color toner is mixed within the development device (the development chamber 48H and the developer storage chamber 49I) from when the maximum amount of toner is left in the developer cartridge 49 to when the amount of toner in the developer cartridge 49 is less than the predetermined amount.

At first, if the printing operation is repeatedly carried out until the amount of toner in a brand-new developer cartridge 49 decreases less than the predetermined amount, 0.2 g of different color toner is mixed within the development device. It is to be noted that the amount of mixed toner in the developer storage chamber 49I is the same as the amount of mixed toner in the development chamber 48H at a time when the developer cartridge 49 is replaced with a new one. Therefore, supposing that the different color toner is uniformly distributed, 0.1 g of different color toner is present in each of the developer storage chamber 49I and the development chamber 48H at the time of replacement of the developer cartridge 49.

In this instance, if the developer cartridge 49 is replaced with a new one, the amount of different color toner contained in the developer storage chamber 49I of the new developer cartridge 49 and the development chamber 48H becomes 0.1 g. Thereafter, if toner is circulated between the developer storage chamber 49I and the development chamber 48H and the different color toner is well mixed and uniformly distributed, 0.05 g of different color toner will be present in each of the developer storage chamber 49I and the development chamber 48H. During the time that the amount of toner in the developer storage chamber 49I decreases less than the predetermined amount, 0.2 g of different color toner will be further mixed into the development chamber 48H and uniformly distributed between the developer storage chamber 49I and the development chamber 48H, so that 0.15 g of different color toner will be present in each of the developer storage chamber 49I and the development chamber 48H at the time of replacement of the developer cartridge 49. Repeating this will cause the amount of different color toner remaining in the development chamber 48H at the time of replacement to be changed to 0.175 g, 0.1875 g, etc., but the amount of the different color toner is always less than 0.2 g. This can be shown by the following formula:

$$M = \frac{1}{2}X + \sum_{k=1}^{n} \frac{1}{2^{k+1}} X$$

where M is the amount of different color toner remaining in the development chamber at the time of replacement of the developer cartridge, and X is the amount of different color toner to be mixed, and n is the number of replacement of the developer cartridge.

According to this formula, it is to be understood that the amount of different color toner (M) remaining in the development chamber 48H at the time of replacement of the developer cartridge 49 does not exceed the amount of different color toner (X) to be mixed. On the contrary, if the color laser printer is constructed such that toner is not circulated between the development chamber 48H and the developer storage chamber 49I, the amount of different color toner remaining in the development chamber 48H rapidly increases to 0.2 g, 0.4 g, 0.6 g, etc.

According to this embodiment, the following advantageous effects can be obtained.

(1) Different color toner is circulated between the development chamber 48H and the developer storage chamber 49I, and the developer cartridge 49 can be replaced with a new one with mixed toner remaining in the old developer cartridge 49. Therefore, it is possible to restrict a rapid increase of the content of mixed toner within the development chamber 48H and thus to restrict reduced service life of the developing unit 48.

(2) The user is notified about replacement of the developer cartridge 49 when the amount of toner remaining in the developer storage chamber 49I becomes equal to the remaining amount of toner in the development chamber 48H. Therefore, as explained above with reference to the formula, the amount of different color toner (M) remaining in the development chamber 48H does not exceed the amount of different color toner (X) to be mixed. As a result, an increase in the amount of different color toner in the development chamber 48H can be restricted at an extremely low level.

(3) The amount of toner in the developer storage chamber 49I is detected by the optical sensors 100. This contributes to a simplified structure.

(4) The partition wall WH having communication openings 49B, 48D, 49E, 48E at its both end portions (first and second end portions), the agitator 60, and the augers 70, 80 constitute the circulation mechanism, so that toner can be well mixed and circulated throughout the whole region in the process cartridge 4. As an alternative embodiment, the partition wall may have communication openings at its center and at one end thereof, through which toner is circulated. However, in this alternative, toner will accumulate at the other end of the partition wall WH. Therefore, the circulation mechanism according to the above embodiment is more preferable.

(5) The collection carrier mechanism includes the auger 80 which is driven to rotate around its rotation axis to carry toner along the direction of the rotation axis. Therefore, even if the development device is of a type where the developer storage chamber 49I is positioned above the development chamber 48H, the rotation of the auger 80 can reliably cause toner to be carried along its rotation axis from one end side (second end side) of the development chamber 48H to one end side (second end side) of the developer storage chamber 49I.

(6) The auger 80 is connected to one end portion (second end portion) of the supply roller 48A via bevel gears 82, 83. This allows the drive source for the supply roller 48A to be also used as a drive source for the auger 80.

(7) According to this embodiment, the auger 80 is positioned outside the image forming width that is defined within the development chamber 48H. The density of toner may decrease below the auger 80 due to reduction of pressure. Arranging the auger 80 outside the image forming width can eliminate the possibility of forming a faint-colored printed image due to the reduction of pressure.

(8) The rotary driving force transmission mechanism 90 for the agitator 60 and the auger 70 is arranged opposite to the auger 80 with the developer storage chamber 49I and the development chamber 48H interposed therebetween. The rotary driving force transmission mechanism 90 is arranged at the other end side (first end side) so as not to interfere with the auger 80 and the auger drive mechanism such as the bevel gears 82, 83. This can effectively use the installation space.

(9) According to this embodiment, single component nonmagnetic toner is used as developer. In the development system using single component nonmagnetic toner, deterioration of toner due to rubbing is a particular concern. Toner is electrically charged when it is rubbed between the developing roller 48B and the supply roller 48A and between the developing roller 48B and the doctor blade. Therefore, each time the developing roller 48B rotates by 360 degrees, toner on the developing roller 48B is rubbed and deteriorates accordingly. For this reason, it is necessary to take measures for preventing deterioration of toner. According to this embodiment, even if single component nonmagnetic toner is used and the toner deteriorates by the rotation of the developing roller 48B, replacement of the developer cartridge 49 and circulation of toner between the developer storage chamber 49I and the development chamber 48H can decrease the content of deteriorated toner. This can make it possible to form a clear and favorable image throughout the image forming width.

(10) According to this embodiment, the development chamber 48H is formed in the developing unit 48 and the developer storage chamber 49I is formed in the developer cartridge 49 that is attached to and detachable from the developing unit 48, and the auger 80 as the collection carrier mechanism is arranged within the developer cartridge 49. Therefore, the auger 80 carries toner such that toner in the development chamber 48H is lifted upward. Particularly, the position at which the auger 80 supplies collected toner to the developer storage chamber 49I is arranged above the rotation shaft 61 of the agitator 60 and also above the toner stored in the developer storage chamber 49I. This can eliminate a load applied to the toner when compared with the case in which collected toner is supplied from below the toner stored in the developer storage chamber 49I, so that deterioration of toner can be prevented and a smooth carrying of toner is achieved.

Although the present invention has been described in detail with reference to the above preferred embodiment, the present invention is not limited to this specific embodiment and various changes and modifications may be made without departing from the scope of the appended claims.

Figure 11:
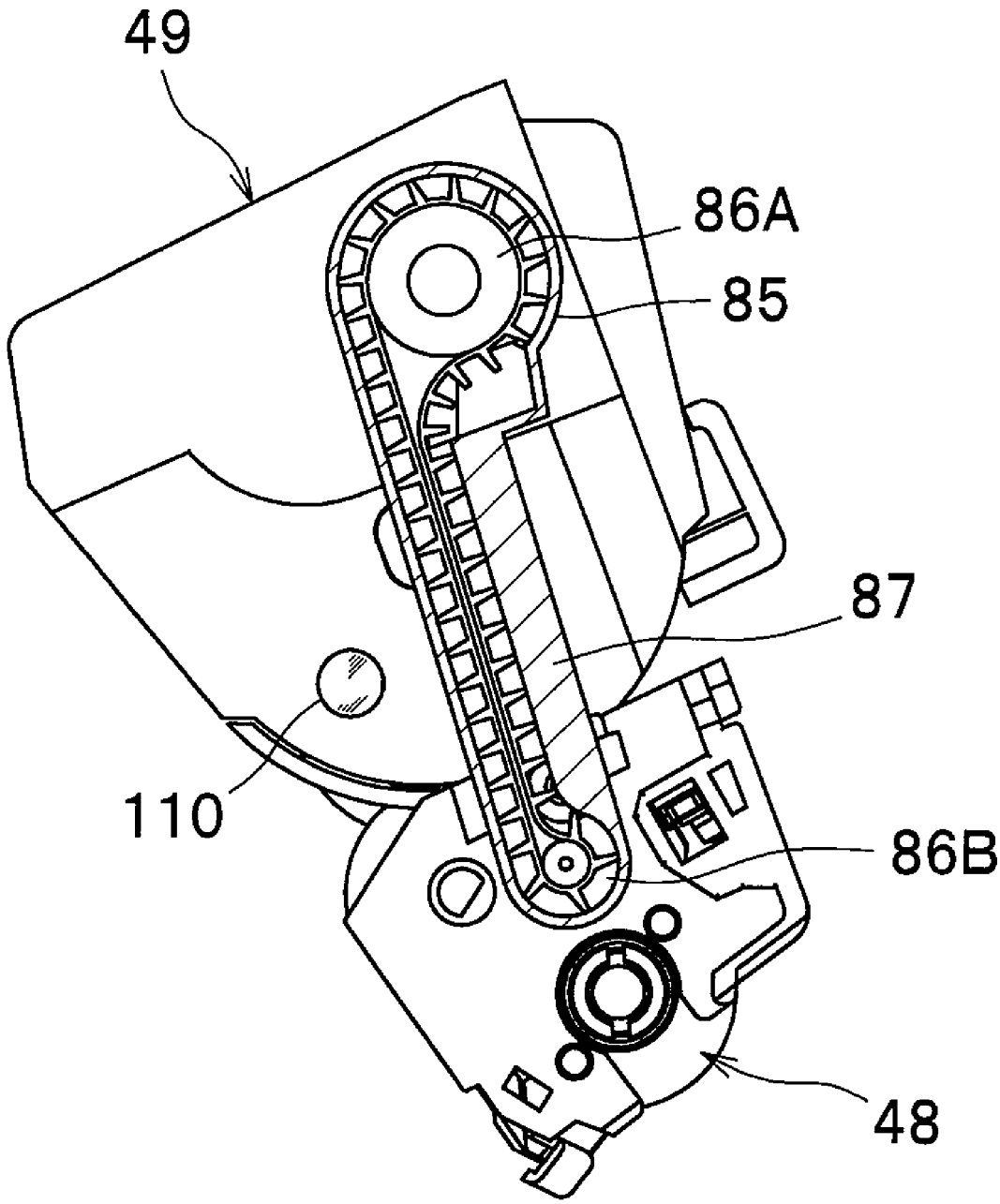
FIG. 11 is a side section of a modified development device in which the auger is replaced with a geared conveyor belt.

The development device is not limited to the specific development device as described above. For example, the auger 80 such as shown in FIG. 6 as the collection carrier mechanism may be arranged within the development chamber 48H of the developing unit 48 and outside the image forming width. Further, the auger 80 may be modified by replacing it with a geared conveyor belt such as shown in FIG. 11. In this modified embodiment, the developer cartridge 49 is provided with a drive pulley 86A and a driven pulley 86B, and a geared conveyor belt 85 is looped around these two pulleys 86A, 86B. The geared conveyor belt 85 is covered by a housing 87. According to this modification, when the drive pulley 86A is driven to rotate, toner is carried from one side of the development chamber 48H to one side of the developer storage chamber 49I.

In the above preferred embodiment, the present invention has been applied to the color laser printer 1. However, the present invention is not limited to this specific embodiment. The present invention is applicable to other image forming apparatus such as a copying machine and a multifunction device.

In the above preferred embodiment, the conveyor belt 43C is employed as a belt. However, the present invention is not limited to this specific embodiment. As an alternative embodiment, an intermediate transfer belt may be employed, onto which different toner images are superposed to form a complete toner image that is to be transferred onto a recording sheet.

In the above preferred embodiment, the photosensitive drum 47A is employed as a photosensitive member. However, the present invention is not limited to this specific embodiment. For example, a belt-type photosensitive member may be employed.

In the above preferred embodiment, the drum cleaner 47B in the shape of a roller is employed as an example of a retaining member. However, a brush-type drum cleaner may be employed. Further, instead of providing a plurality of retaining members for each of the corresponding process cartridges 46 as described in the above preferred embodiment, at least one retaining member may be provided; preferably, the retaining member is provided at a process cartridge for a third color or a fourth color from the upstream-most process cartridge, and the downstream-most process cartridge for the fourth color is most preferable.

In the above preferred embodiment, toner is charged positively. However, toner may be charged negatively. In this instance, an electric voltage across the drum cleaner 47B or the transfer roller 43D is reversely controlled in accordance with the electric charge of the toner.

In the above preferred embodiment, the circulation mechanism essentially consists of the partition wall WH having communication openings 48D, 49B, 48E, 49E at both end portions, the agitator 60, and the augers 70, 80. However, the present invention is not limited to this specific embodiment. For example, three openings (one formed in the center and two at both ends) may be formed in the partition wall WH, and a circulation mechanism using appropriate augers may be provided such that toner is supplied from the developer storage chamber to the development chamber through the center opening whereas toner in the development chamber is returned from the development chamber to the developer storage chamber through the two end openings.

In the above preferred embodiment, the cleaning unit 43E having a plurality of rollers is employed as a cleaning device. However, the present invention is not limited to this specific embodiment. For example, an elastic blade may be employed which is arranged in contact with the conveyor belt 43C to scrape toner off from the surface of the conveyor belt 43C.

Further, in the above preferred embodiment, the optical sensors 100 are employed as detectors. However, the present invention is not limited to this specific embodiment. For example, a mechanical sensor may be employed, which consists of a rocking arm pivotally supported on the inner wall of the developer cartridge 49 at one end thereof, a float fixed to the other end of the rocking arm and placed on the upper surface of the toner that is stored in the developer cartridge 49, and a rotary encoder for detecting rotation angle of a pivotable shaft of the rocking arm.

In the above preferred embodiment, the amount of toner to be left in the developer cartridge 49 upon replacement of the developer cartridge 49 is set equal to the remaining amount of toner remaining in the development chamber 48H. However, the present invention is not limited to this specific embodiment. The amount of toner to be left in the developer cartridge 49 may be set greater than or less than the remaining amount of toner in the development chamber 48H. However, in order to restrict an increase in the content of the mixed toner in the development chamber 48H, it is preferable that the amount of toner to be left in the developer cartridge 49 is set equal to or greater than the remaining amount of toner in the development chamber 48H.

What is claimed is:

1. An image forming apparatus comprising:

a plurality of photosensitive members;

at least one retaining member positioned in contact with a corresponding photosensitive member and configured to temporarily retain remaining developer remaining on this photosensitive member;

a belt arranged opposite to the plurality of photosensitive members;

a cleaning device positioned in contact with the belt and configured to collect developer on the belt;

a remaining developer collecting unit configured to cause the remaining developer retained by the retaining member to be transferred onto the belt via the photosensitive member and thereafter to be collected by the cleaning device;

a plurality of developing units each including a developing roller positioned in contact with a corresponding photosensitive member to supply developer to the photosensitive member, and a development chamber accommodating the developing roller;

a plurality of developer receptacles configured to be attached to and removed from corresponding developing units, and each having a developer storage chamber for storing developer;

a circulation mechanism configured to circulate developer between the development chamber and the developer storage chamber;

a detector detecting the amount of developer stored in the developer storage chamber;

a determination unit configured to determine if the amount of developer stored in the developer storage chamber is less than a predetermined amount based on a signal from the detector; and a notifying unit configured to notify a user to replace a developer receptacle when the determination unit determines that the amount of developer stored in the developer storage chamber is less than the predetermined amount, wherein the predetermined amount is set equal to or greater than a remaining amount of developer remaining in the development chamber.

2. An image forming apparatus according to claim 1, wherein a detection window and a light transmission window are provided opposite to each other at side walls of each developer receptacle with the developer storage chamber interposed therebetween, and wherein the detector comprises:

a light emitting portion configured to emit light through the detection window; and a light receiving portion configured to receive the light emitted from the light emitting portion through the light transmission window, and the detection window and the light transmission window are positioned higher than a bottom face of the developer receptacle.

3. An image forming apparatus according to claim 1, wherein the circulation mechanism comprises:

a partition wall defined by part of walls of the developing unit and the developer receptacle, the partition wall having a first opening through which developer is supplied from the developer storage chamber to the development chamber, and a second opening through which developer is supplied from the development chamber to the developer storage chamber;

a feed out carrier mechanism arranged in the developer storage chamber and configured to carry developer in a direction from the second opening to the first opening of the developer storage chamber and to feed developer out from the developer storage chamber and into the development chamber;

a supply carrier mechanism arranged in the development chamber and configured to carry developer in a direction from the first opening to the second opening of the development chamber and to supply developer to the developing roller; and a collection carrier mechanism arranged in the developer storage chamber or the development chamber close to the second opening and configured to carry developer from the development chamber to the developer storage chamber.

4. An image forming apparatus according to claim 3, wherein the collection carrier mechanism is positioned outside an image forming width that is defined within the development chamber.

5. An image forming apparatus according to claim 4, wherein the collection carrier mechanism comprises an auger configured to be driven about its rotation axis and to carry developer along the rotation axis.

6. An image forming apparatus according to claim 5, wherein bevel gears are provided between the auger and an end of a developer supply member that is accommodated in the development chamber and driven to rotate.

7. An image forming apparatus according to claim 4, wherein a rotary driving force transmission mechanism for the feed out carrier mechanism and the supply carrier mechanism is arranged opposite to the collection carrier mechanism with the developer storage chamber and the development chamber interposed therebetween.

* * * * *